United States Patent [19]

Folsberg

[11] Patent Number: 4,869,434

[45] Date of Patent: Sep. 26, 1989

[54] VERTICAL ROLLER MILL

[75] Inventor: Jan Folsberg, Copenhagen, Denmark

[73] Assignee: F.L. Smidth & Co. A/S, Denmark

[21] Appl. No.: 281,256

[22] Filed: Dec. 7, 1988

[30] Foreign Application Priority Data

Dec. 24, 1987 [GB] United Kingdom ..... 8730110

[51] Int. Cl.[4] ..... B02C 25/00; B02C 23/26

[52] U.S. Cl. ..... 241/34; 241/119

[58] Field of Search ..... 241/33, 34, 117–121

[56] References Cited

U.S. PATENT DOCUMENTS

| | | | |
|---|---|---|---|
| 1,623,287 | 4/1927 | Straight | 241/119 X |
| 2,610,802 | 9/1952 | McIlvaine | 241/121 X |
| 2,984,423 | 5/1961 | Roth | 241/231 X |
| 4,442,980 | 4/1984 | Oetiker et al. | 241/34 |
| 4,489,895 | 12/1984 | Petersen | 241/19 |
| 4,582,260 | 4/1986 | Folsberg | 241/19 |
| 4,715,544 | 12/1987 | Folsberg | 241/57 |

*Primary Examiner*—Timothy V. Eley

*Attorney, Agent, or Firm*—Brumbaugh, Graves, Donohue & Raymond

[57] ABSTRACT

A vertical roller mill has a rotatable grinding table (1) which is fed with material to be ground through a feed pipe (14) so that a cone of material is formed between the bottom of the pipe and the table, and scrapers (25) for intercepting the cone and spreading the material over the table and under grinding rollers. In order to avoid the feed pipe running empty so that the cone is not formed, sensors (21) sense the level of material in the pipe and controlling means (19,20) responsive to the sensors adjust the height of the feed pipe and/or the angle of the scrapers.

2 Claims, 3 Drawing Sheets

VERTICAL ROLLER MILL

DESCRIPTION

The invention relates to a vertical roller mill of the kind (hereinafter referred to as of the kind described) comprising a mill housing encasing a grinding table which is rotatable about a vertical axis, at least two grinding rollers rotatable about substantially stationary axes, and urged against the grinding table, and a feed pipe for the supply of material, to be ground on the grinding table, down towards the central part of the grinding table, the feed pipe being positioned co-axially with and at a distance above the grinding table.

The feed pipe is primarily charged with fresh unground material, but even material which drops down around the table after being ground on the grinding table can be discharged from the mill and recycled to the feed pipe for renewed grinding by means of an external conveyor. The material supplied to the feed pipe may also comprise a separated coarse fraction of ground material, which is conveyed by a conveying gas from the grinding compartment of the mill and into a separator at the top of the mill, where the ground material is divided into a finish-ground fine fraction which is discharged from the mill, and the aforementioned coarse fraction which is returned to the feed pipe.

The material fed to the feed pipe is discharged at the bottom of the pipe and flows down towards the central part of the grinding table, where it is flung out under the grinding rollers and subjected to grinding between the grinding table and grinding rollers.

In the gap between the feed pipe and the grinding table the outflowing material forms a frusto cone of material, with a cone angle depending on the properties of the material and the rotational speed of the grinding table.

As long as the feed pipe is more or less filled with material with resultant formation of the material cone between the grinding table and the feed pipe, the material will be distributed in an equal and uniform pattern under the different rollers. However, if the feed pipe is run empty, that is to say if there is no material column in the feed pipe, the material supplied to the feed pipe will pass through and leave the pipe in an uncontrolled flow so that the material is not evenly distributed between the grinding rollers. This may entail one grinding roller being provided with a material layer for processing whereas another roller is without grinding material, which causes an uneconomical operation of the mill and a risk of damage to the grinding table and grinding rollers.

It is the object of the invention to remedy the above-mentioned disadvantages by ensuring that the feed pipe is never completely emptied of nor overfilled with material.

According to the invention this is obtained by a mill of the kind described which is characterized in that the feed pipe is provided with at least one level sensor for measuring, in use, the actual material level in the pipe, in that scrapers are mounted above the central part of the grinding table, the number of scrapers corresponding to that of the grinding rollers, for equal and uniform distribution of the material flow from the feed pipe to the grinding rollers, and in that controlling means responsive to the level sensor(s) are provided for regulation of the material flow rate from the feed pipe to the grinding rollers to prevent the feed pipe from running empty.

Hence by ensuring that the material flow to the grinding rollers is constantly adapted to the current material level in the feed pipe, the result is that the feed pipe is actively prevented from running empty and all rollers will have material for grinding, in a smaller or larger grinding cushion thickness.

The controlling means may be configured in various manners and may thus comprise devices for raising or lowering of the feed pipe in relation to the grinding table, i.e. an increase or reduction in the gap between the lower end of the feed pipe and the grinding table.

The controlling means may also or alternatively comprise devices for turning the scrapers relatively to the central part of the grinding table, whereby the scrapers are adjusted for scraping of a major or minor material volume from the outlet cone of the material under the feed pipe out towards the grinding rollers.

The invention will now be explained in more detail by means of an example of a vertical roller mill according to the invention, with reference made to the accompanying diagrammatic drawing, in which.

Figure 1:
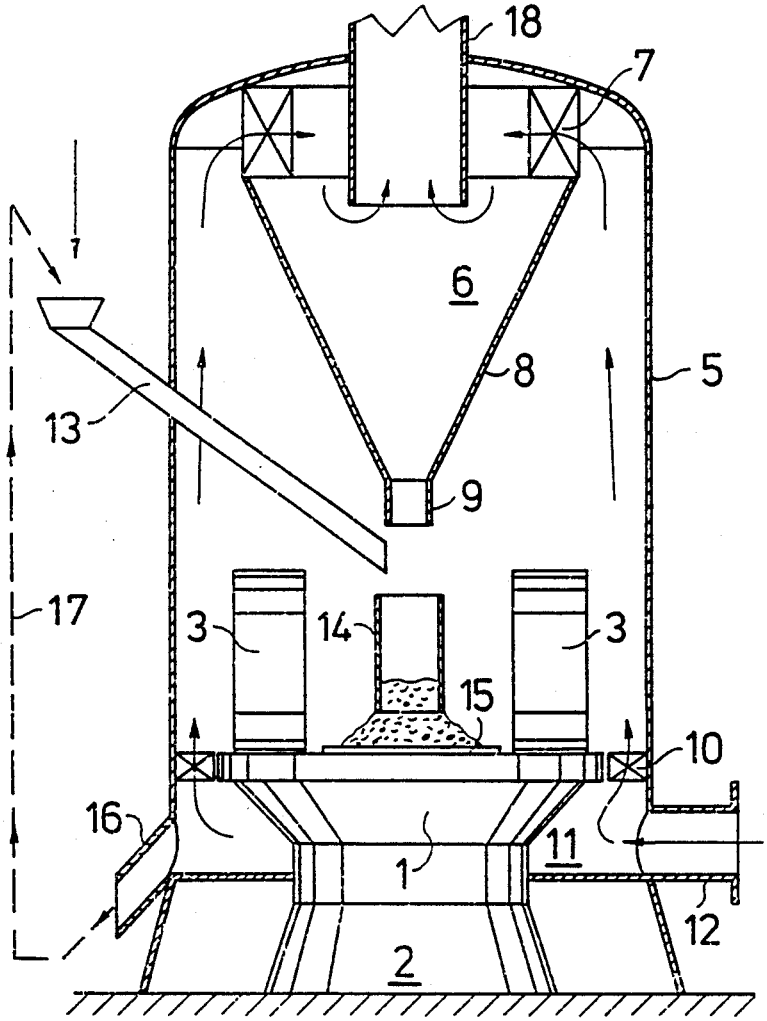
FIG. 1 shows a vertical section of a prior art vertical roller mill.

The known mill in FIG. 1 comprises a grinding table rotatable about its vertical axis and driven via a gear unit 2. Rolling on the grinding table 1 are grinding rollers mounted on shafts, not shown, and urged against the grinding table 1 by means of known, but not shown, pull or pressure means.

The mill is encased by a housing 5, which has a built-in separator 6 at the top. The separator 6 incorporates in its inlet adjustable louvres 7 and at the bottom an outlet hopper 8 with an outlet 9.

The grinding table 1 is surrounded by a nozzle ring 10, through which conveying gas can flow from a chamber 11 under the nozzle ring and grinding table. The chamber 11 is fed with gas from a gas supply line 12.

Fresh unground material to be fed to the mill is introduced into the mill through a supply pipe 13 ending at the top of a feed pipe 14, co-axially with the grinding table and at a distance above its central part 15.

The material introduced into the mill through the supply pipe 13 passes down through the feed pipe 14 to the central part 15 of the grinding table, wherefrom, through the rotation of the grinding table, the material is flung outwards and ground under the grinding rollers.

The ground material is flung onward over the nozzle ring 10 and scavenged by the conveying air from the latter. Particles which are too heavy to be suspended in the conveying gas and carried upwards in the mill, drop through the nozzle ring and are discharged from the space under the nozzle ring through an outlet 16, wherefrom the particles are carried to the supply pipe 13 by means of an external conveyor indicated at 17 and returned to the mill for renewed grinding.

Lighter particles of ground material which can be suspended in and carried up through mill by the conveying gas, are diverted, as indicated with arrows, to the louvres 7 of the separator inlet and into the separator, in which the material is divided into a fine fraction, which is discharged from the mill through a top outlet 18, and a course fraction, which drops down along the sides of the hopper 8, out through the outlet 9 and down into the feed pipe 14.

In case the material supplied to the feed pipe 14, coming partly from the separator outlet 9 and partly from the supply pipe 13 are already mentioned, represents such a volume that the feed pipe 14 cannot be emptied, the material in the gap between the central part 15 of the grinding table and the lowermost end of the feed pipe 14 will form an outlet cone, as indicated in the drawing, ensuring a reasonably uniform distribution pattern of the material under the different grinding rollers.

However, if the feed pipe is emptied because of inadequate material supply to the feed pipe 14, the material will pass in a thinner stream down through the feed pipe 14 so that it is flung out at an arbitrary point on the grinding table, involving risk that only one or some of the grinding rollers receive material for grinding whilst one or other grinding rollers roll direct on the grinding table with risk of damage to the grinding table and rollers, and, further, with an uneconomical operation of the mill.

Figure 2:
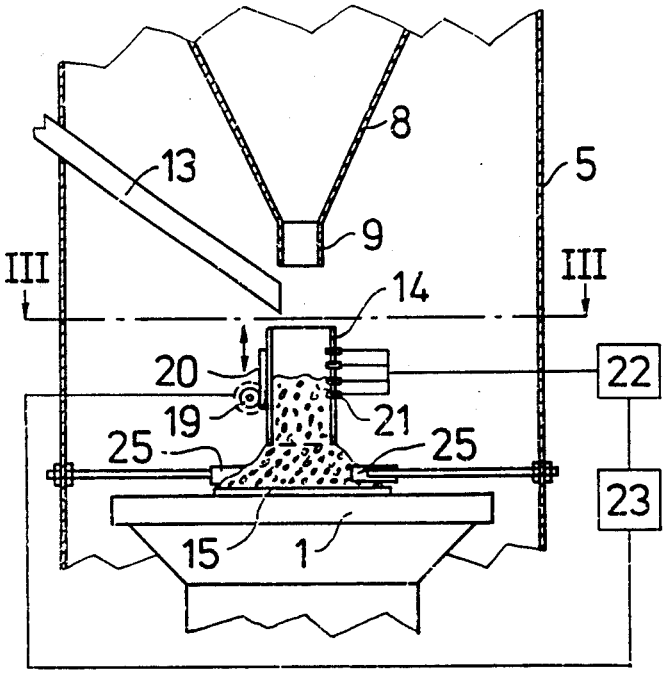
FIG. 2 is a vertical section of part of a first example of a vertical roller mill according to the invention.
Figure 3:
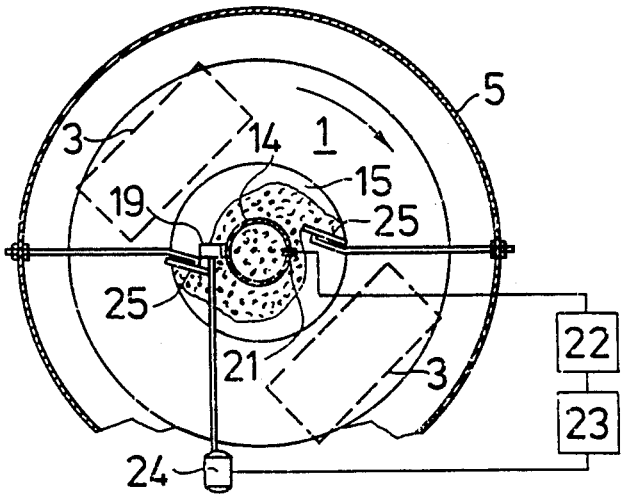
FIG. 3 is a section taken on the line III—III in FIG. 2.

FIGS. 2 and 3 show a mill according to the invention, with reference numbers for the same parts identical to those applied in FIG. 1.

Here the feed pipe 14 is made movable in the vertical direction, as indicated by means of a pinion 19, which interacts with a rack 20 fixed to the feed pipe 14. Further, the feed pipe 14 is equipped with level sensors 21, interconnected with a monitor 22, which supplies signals to a regulating device 23, which in turn controls a drive motor 24 operating the pinion 19.

The operational characteristics of this control system are such that if the level sensors report a drop in the level of material in the feed pipe 14 the pinion 19 is rotated to lower the feed pipe 14 so that a smaller amount of material can pass through the gap between the grinding table 1 and the feed pipe 14. Regulation in the opposite sense takes place if overfilling of the feed pipe is about to occur so that the pipe is lifted to enable a larger amount of material to pass out through the aforementioned gap.

Scrapers 25, in the present instance two, corresponding to the two rollers 3 indicated in FIG. 3, are mounted over the central part 15 of the grinding table to provide uniform scraping and distribution of grinding material outwards under the two rollers 3. In the example shown in FIGS. 2 and 3 the scrapers are stationary.

Figure 4:
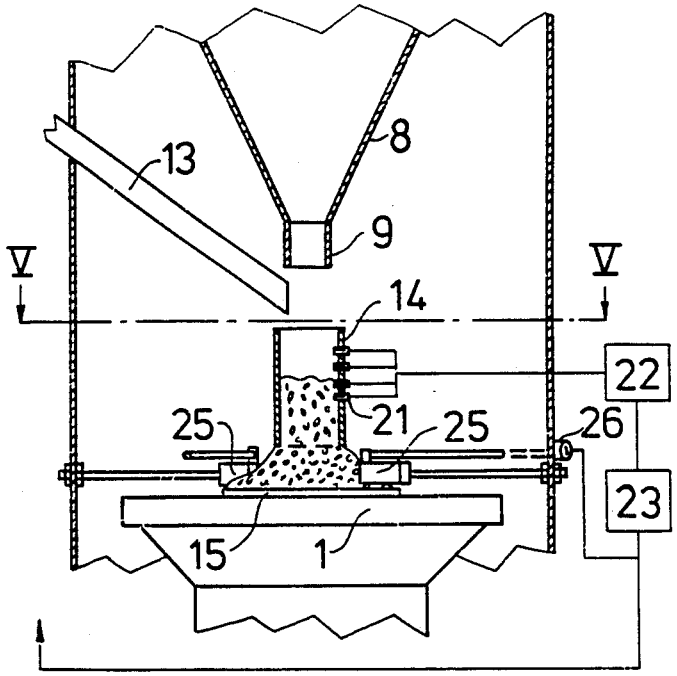
FIG. 4 is a section corresponding to FIG. 2, but of a second example of a vertical roller mill according to invention; and, FIG. 5 is a section taken on the line V—V in FIG. 4.
Figure 5:
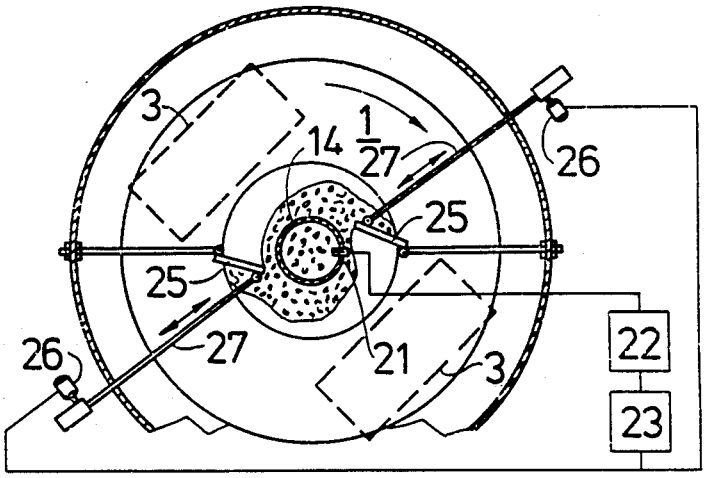

FIGS. 4 and 5 show another control system in which, in contrast to the example in FIGS. 2 and 3, the feed pipe 14 is stationary whilst the scrapers 25 are arranged to turn whereby they can scrape off a larger or smaller amount of material from the material cone in the gap between the feed pipe 14 and the grinding table 1.

In this case the signals from the level sensors 21 are used via the monitor 22 and the controller 23 to operate motors 26, which, through the action of tension rods 27, can adjust the scrapers 25 for extraction of a larger or smaller amount of material from the gap between the outlet pipe 14 and the grinding table 1 dependent on the material level in the feed pipe 14.

Even though the drawings indicate regulation of distance between feed pipe 14 and the grinding table 1 or of the inclined position of the scrapers 25 over the grinding table 1, the two control systems can be successfully combined so that the mill is provided with a vertically movable feed pipe 14 as well as adjustable scrapers 25, but always so that the grinding rollers 3 roll on grinding cushion of the same, smaller or larger, thickness.

I claim:

1. A vertical roller mill comprising a mill housing encasing a grinding table which is rotatable about a vertical axis, at least two grinding rollers rotatable about substantially stationary axes and urged against said grinding table, and a feed pipe for the supply of material, to be ground on said grinding table, down towards a central part of said grinding table, said feed pipe being positioned co-axially with and at a distance above said grinding table, wherein said feed pipe is provided with at least one level sensor for measuring, in use, the actual material level in said pipe; scrapers are mounted above said central part of said grinding table, the number of scrapers corresponding to that of said grinding rollers, for equal and uniform distribution of the material flow from said feed pipe to said grinding rollers; and controlling means responsive to said level sensor(s) are provided for regulation of the material flow rate from said feed pipe to said grinding rollers to prevent said feed pipe from running empty, said controlling means comprising devices for raising or lowering of said feed pipe in relation to said grinding table.

2. A mill according to claim 1, wherein said controlling means comprises devices for turning said scrapers relatively to said central part of said grinding table.

* * * * *